US009803950B1

(12) United States Patent
Khoshnood et al.

(10) Patent No.: US 9,803,950 B1
(45) Date of Patent: Oct. 31, 2017

(54) ARCHERY BOW STAND

(71) Applicant: Axion Archery LLC, Alpharetta, GA (US)

(72) Inventors: Bahram Khoshnood, Alpharetta, GA (US); Charles Ernest Wagoner, Jr., Alpharetta, GA (US)

(73) Assignee: Axion Archery LLC, Alpharetta, GA (US)

( * ) Notice: Subject to any disclaimer, the term of this patent is extended or adjusted under 35 U.S.C. 154(b) by 0 days.

(21) Appl. No.: 15/229,731

(22) Filed: Aug. 5, 2016

(51) Int. Cl.
*F41B 5/14* (2006.01)
*F41A 23/08* (2006.01)

(52) U.S. Cl.
CPC ..... *F41B 5/1453* (2013.01); *F41B 5/1426* (2013.01); *F41A 23/08* (2013.01)

(58) Field of Classification Search
CPC ..... F41B 5/14; F41B 5/1426; F41B 5/1453; F41A 23/08
USPC ..... 124/86, 88, 89; 248/166, 688; 42/94
See application file for complete search history.

(56) References Cited

U.S. PATENT DOCUMENTS 3,256,872 A * 6/1966 Koser ..... F41B 5/14 124/23.1
4,121,799 A * 10/1978 Michio ..... F16M 11/14 248/171
4,993,398 A * 2/1991 Wallace ..... F41B 5/066 124/23.1
5,106,044 A * 4/1992 Regard, III ..... F41B 5/14 124/23.1
5,205,272 A * 4/1993 Boyer ..... F41B 5/14 124/88
5,547,162 A * 8/1996 Sobolewski ..... F41B 5/14 124/88
5,619,981 A * 4/1997 Breedlove ..... F41B 5/1426 124/86
6,205,992 B1 * 3/2001 Meeks ..... F41B 5/14 124/86
6,487,807 B1 * 12/2002 Kopman ..... F41A 23/12 42/72
6,957,648 B1 * 10/2005 Adcock ..... F41B 5/1426 124/86
7,036,497 B2 * 5/2006 Horn ..... F41B 5/14 124/86
7,314,199 B1 * 1/2008 Ward ..... F41B 5/14 248/150
7,347,402 B2 * 3/2008 White ..... F16M 11/14 124/86
7,421,815 B1 * 9/2008 Moody ..... F41C 23/16 248/171
7,426,800 B2 * 9/2008 Pierce ..... F41A 23/10 248/166
7,434,773 B1 * 10/2008 Minjares ..... F41A 23/06 124/86
7,484,699 B1 * 2/2009 Ziegler ..... A45F 3/44 248/156
7,584,568 B1 * 9/2009 Brownlee ..... F41C 23/16 42/94
7,676,977 B1 * 3/2010 Cahill ..... F16M 11/16 248/168

(Continued)

*Primary Examiner* — Alexander Niconovich
(74) *Attorney, Agent, or Firm* — Walter A. Rodgers

(57) ABSTRACT

An archery bow stand includes a base with a pair of legs rotatably interconnected to the base and initially disposed in a storage condition and then extendable from the base to diverge into an operating condition by the action of a spring.

13 Claims, 31 Drawing Sheets

(56) References Cited

U.S. PATENT DOCUMENTS

| | | | | |
|---|---|---|---|---|
| 7,677,233 | B2 * | 3/2010 | Bednar | F41A 23/06 124/25 |
| 7,685,756 | B2 * | 3/2010 | Moody | F41A 23/08 42/71.01 |
| 7,841,120 | B2 * | 11/2010 | Teetzel | F41A 23/08 42/72 |
| 7,987,625 | B1 * | 8/2011 | Moody | F41A 23/10 248/161 |
| 8,328,147 | B2 * | 12/2012 | Gardner | F41A 23/06 124/86 |
| 9,169,958 | B2 * | 10/2015 | Yan | F16M 11/00 |
| 9,285,075 | B2 * | 3/2016 | Moody | F41A 23/08 |
| 9,310,153 | B2 * | 4/2016 | Nettleton | F41A 23/10 |
| 2002/0066446 | A1 * | 6/2002 | Kesti | F41B 5/14 124/86 |
| 2005/0241206 | A1 * | 11/2005 | Teetzel | F41C 23/16 42/72 |
| 2008/0052979 | A1 * | 3/2008 | Lee | F41A 23/04 42/94 |
| 2009/0056192 | A1 * | 3/2009 | Oz | F41C 23/16 42/94 |

* cited by examiner

ARCHERY BOW STAND

BACKGROUND OF THE INVENTION

Conventional archery bows are quite expensive and typically have various accessories attached to the bow. When not in use, oftentimes the bow is simply placed on the ground risking the possibility that it might be stepped upon or even overlooked, especially if the bow is camouflaged. Of course, casually placing the bow on the ground can easily cause damage to the bow including misalignment of the sight and possibly allow dirt and debris to interfere with the operation of the bow pulleys.

As an alternative to simply laying the bow on the ground, it is desirable to provide means for standing the archery bow in a vertical or upright position. In addition, it is necessary to enable the archery bow stand to be stored on the bow in an inconspicuous fashion so as not to interfere with operation of the bow. When the bow stand is to be deployed, it needs to be quickly and easily moved from a position of storage to full deployment so that the archery bow can be conveniently placed on the ground in a secure upright fashion. After use, the bow stand must then be expeditiously returned to a storage condition.

BRIEF SUMMARY OF THE INVENTION

For the purpose of maintaining an archery bow in an upright position when not in active use, an archery bow stand is provided which includes a base and a pair of legs rotatably interconnected to the base so that the legs are deployable from a storage condition within the base to a fully deployed position. When the legs are fully deployed, in one embodiment, they diverge outwardly from the base under spring tension and are held in position in respective notches formed in the base.

In their storage position, in another embodiment, the legs are maintained within the base by means of a plug interconnected to the legs and having an end which cooperates with a narrowed opening formed in the base such that the end is held frictionally within the narrowed opening. When the stand is deployed, the legs are manually withdrawn from the base allowing the legs to diverge by means of a torsion spring.

In a further embodiment, the archery bow stand includes a pair of legs mounted on a pair of pins and rotatable outwardly of the stand base by means of a torsion spring. The legs are maintained in a storage condition within the base whereby a spring sleeve, at least in part, envelopes the base and is urged downwardly by means of a compression spring. The spring sleeve also envelopes the upper ends of the legs when the legs are collapsed.

Also, a dampener in various forms is attachable to the archery bow stand to provide the added benefit of bow vibration dampening.

BRIEF DESCRIPTION OF THE SEVERAL VIEWS OF THE DRAWINGS

In the drawings:

FIG. 3-1 is an exploded view thereof;

FIG. 26-1 is an exploded view thereof;

DETAILED DESCRIPTION OF THE INVENTION

Figure 1:
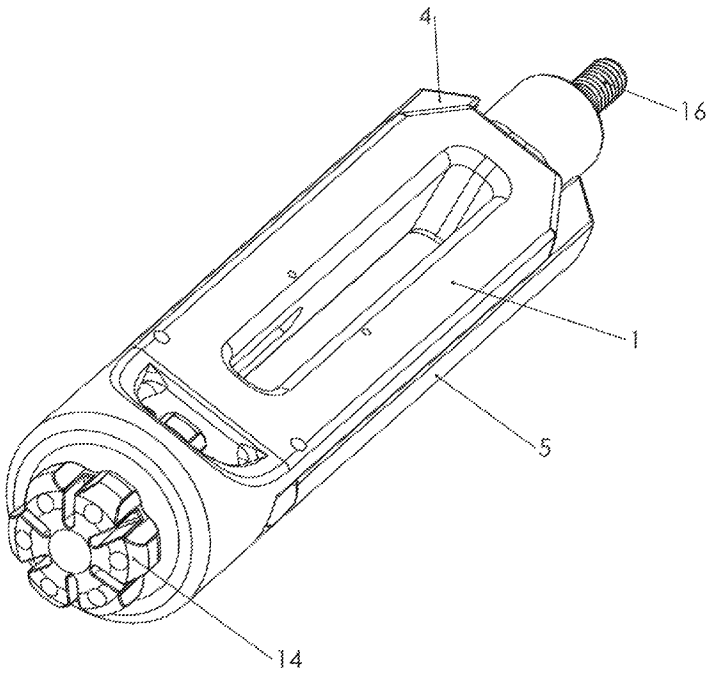
FIG. 1 is a perspective view of an archery bow stand according to this invention.
Figure 2:
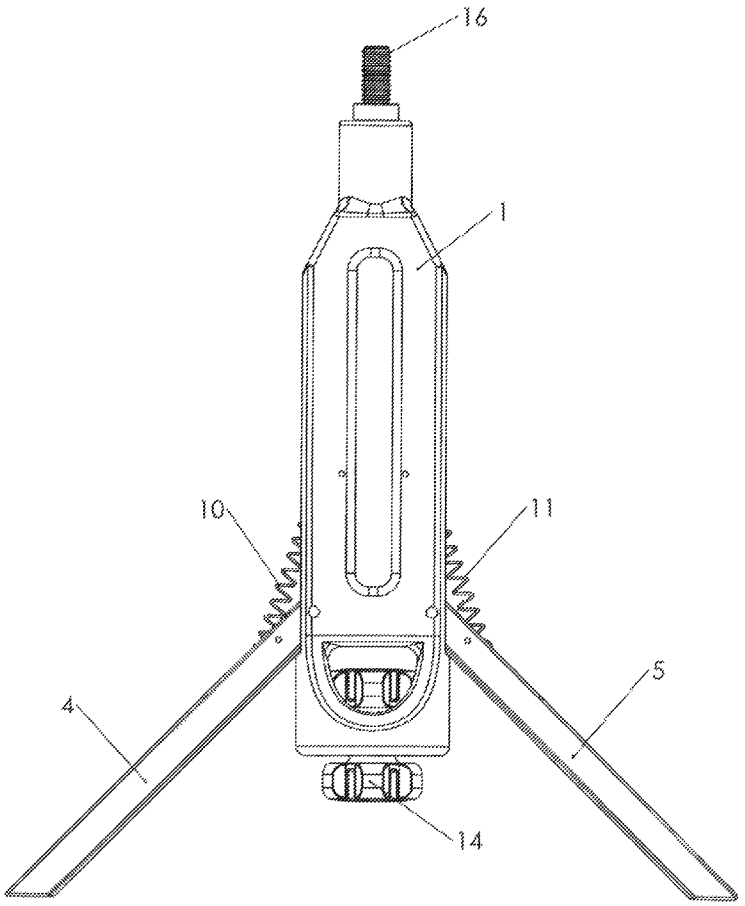
FIG. 2 shows the stand in a deployed condition.
Figure 3:
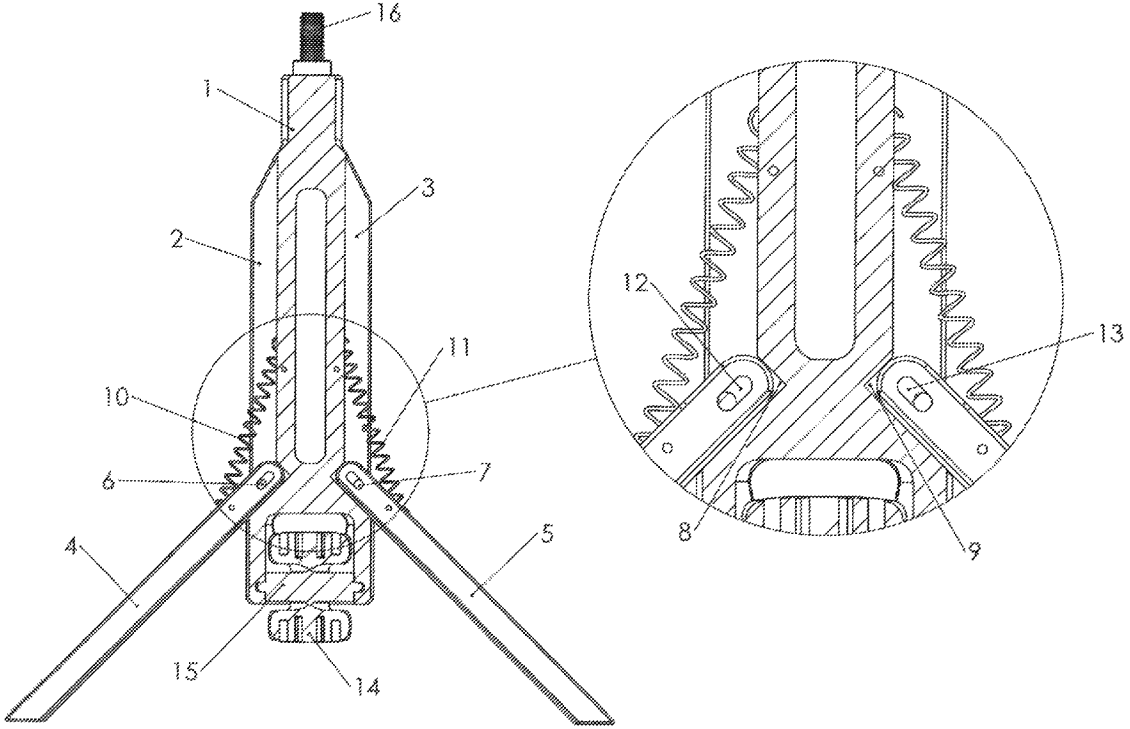
FIG. 3 is an elevational view showing details of the stand.
Figures 1, 3:
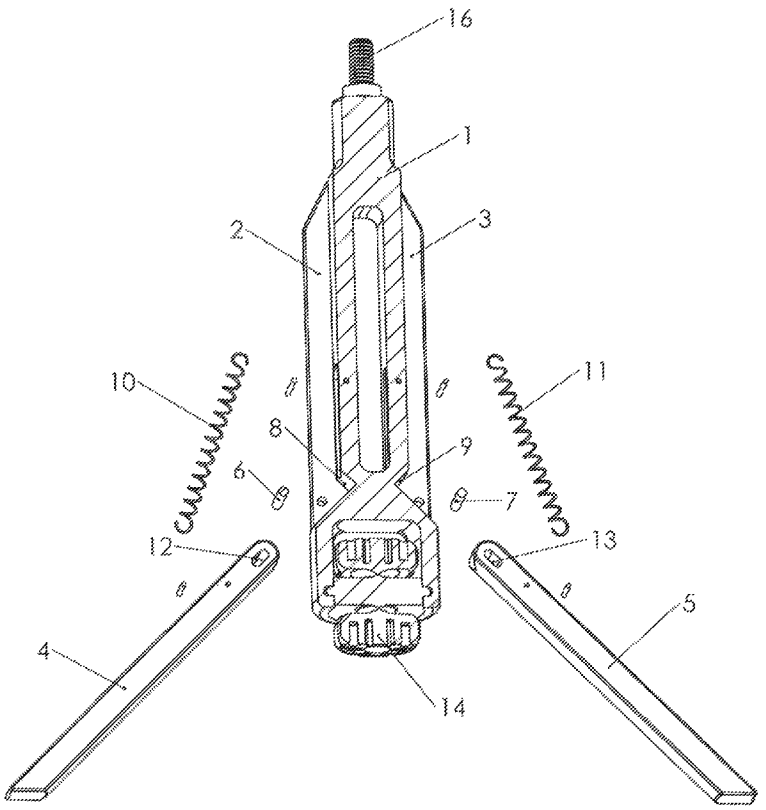
Figure 4:
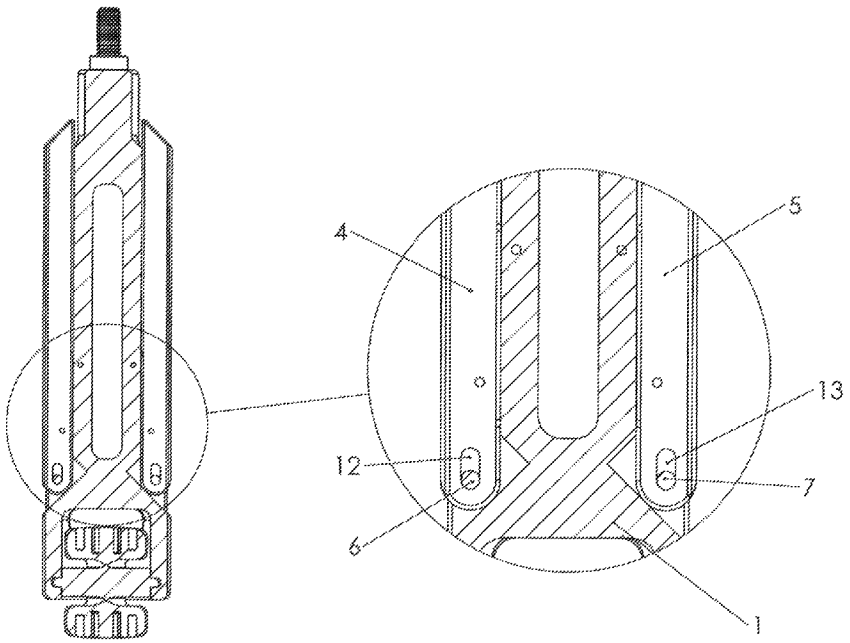
FIG. 4 shows details of the collapsed stand.
Figure 5:
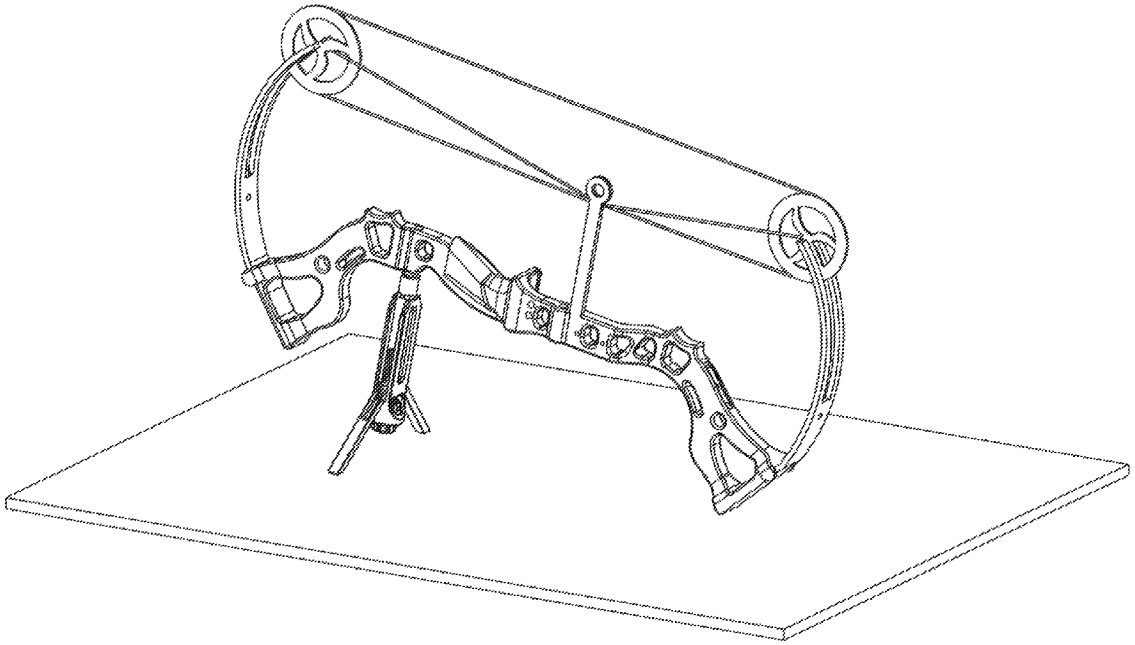
FIG. 5 is a perspective view showing the stand deployed in connection with an archery bow.
Figure 6:
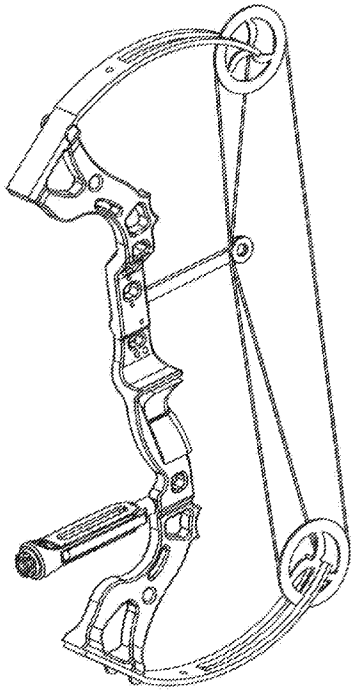
FIG. 6 shows the collapsed stand connected to an archery bow.
Figure 7:
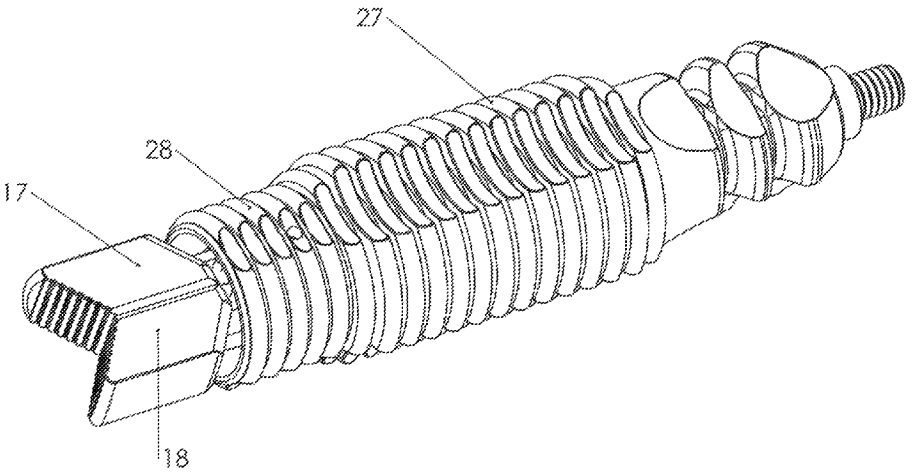
FIG. 7 is a perspective view of another embodiment of the archery bow stand according to this invention.

The archery bow stand according to this invention in one form is shown in FIGS. 1-6 and includes base 1 with spaced elongated slots 2 and 3 formed on the outer periphery thereof. Legs 4 and 5 are rotatable about pins 6 and 7, respectively. When the stand is in an operational condition, as shown in FIG. 3, the inner ends of legs 4 and 5 are held flush against notches 8 and 9, respectively, of base 1 by means of tension springs 10 and 11, respectively. In order to collapse legs 4 and 5, they are simply pulled outwardly of base 1 such that slots 12 and 13 slide on pins 6 and 7, respectively, thereby allowing legs 4 and 5 to move away from notches 8 and 9 and rotate upwardly into positions flush within respective slots 2 and 3 of base 1.

Additional features of the archery bow stand shown in FIGS. 1-6 include vibration dampener 14 which is attached to base 1 by means of dampener base 15, as is well known in the art. Also, mounting means in the form of attachment screw 16 extends from base 1 for the purpose of attaching the stand to an archery bow.

Another embodiment of the archery bow stand according to this invention is shown in FIGS. 7-13 in which legs 17 and 18, in one form, are of elongated U-shaped configurations by means of slots 21 and 22, respectively, and legs 17 and 18 are collapsible for purposes of disposition within hollow base 23. The U-shape of slots 21 and 22 is formed by a bottom and spaced side walls upstanding therefrom. Legs 17 and 18 can also be round, flat, square or of any other suitable profile.

Pins 19 and 20 are interconnected to friction means in the form of sliding plug 24 which includes upwardly extending finger 25 having enlarged end 26. Dampener 27 envelopes base 23 and, similarly, end cap 28 also envelopes base 23. For the purpose of maintaining legs 17 and 18 in an open condition, torsion spring 29 is provided wherein ends 30 and 31 thereof are disposed in U-shaped slots 21 and 22, respectively. Feet 32 and 33 are formed on the ends of legs 17 and 18, respectively, and include edges 34 and 35. Also, attachment arm 36 includes screw 37 and is secured to base 23 by means of multiple screws on pins 38.

Figure 8:
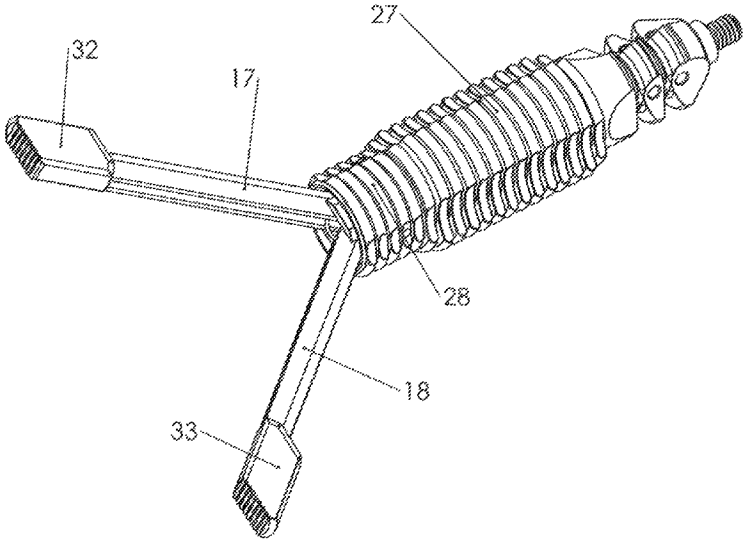
FIG. 8 shows the stand shown in FIG. 7 in the deployed condition.
Figure 9:
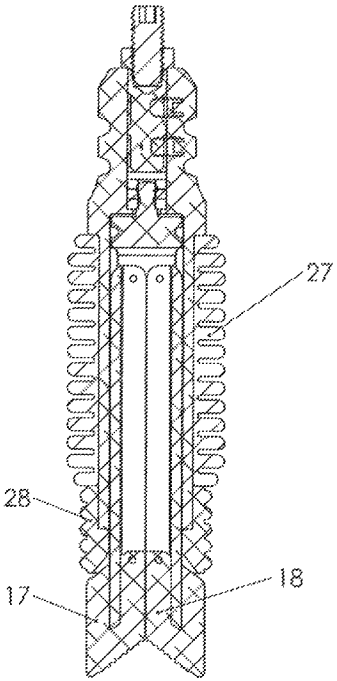
FIG. 9 is a cross-sectional view showing the stand in a collapsed condition.
Figure 10:
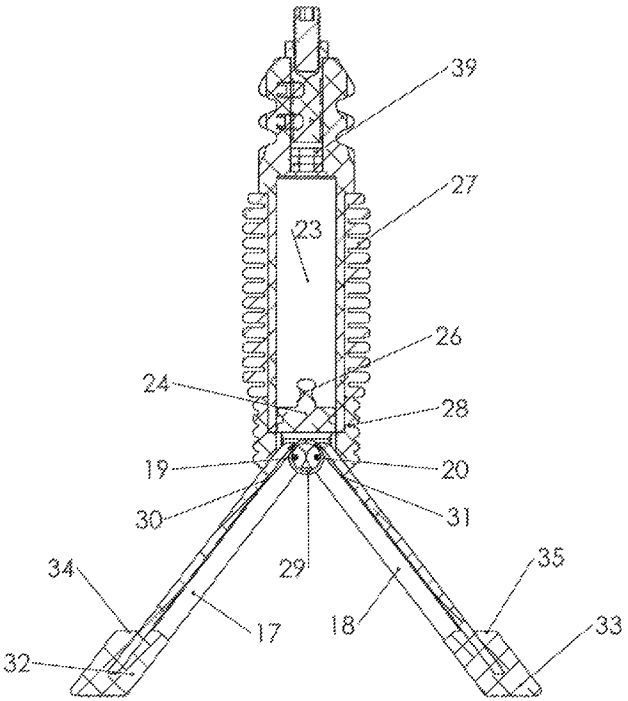
FIG. 10 is a cross-sectional view showing the stand in a deployed condition.
Figure 11:
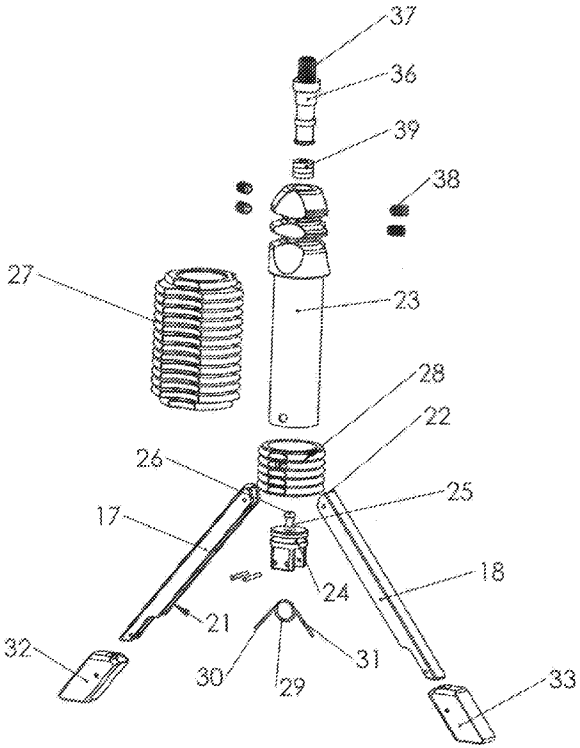
FIG. 11 is an exploded view of the stand.
Figure 12:
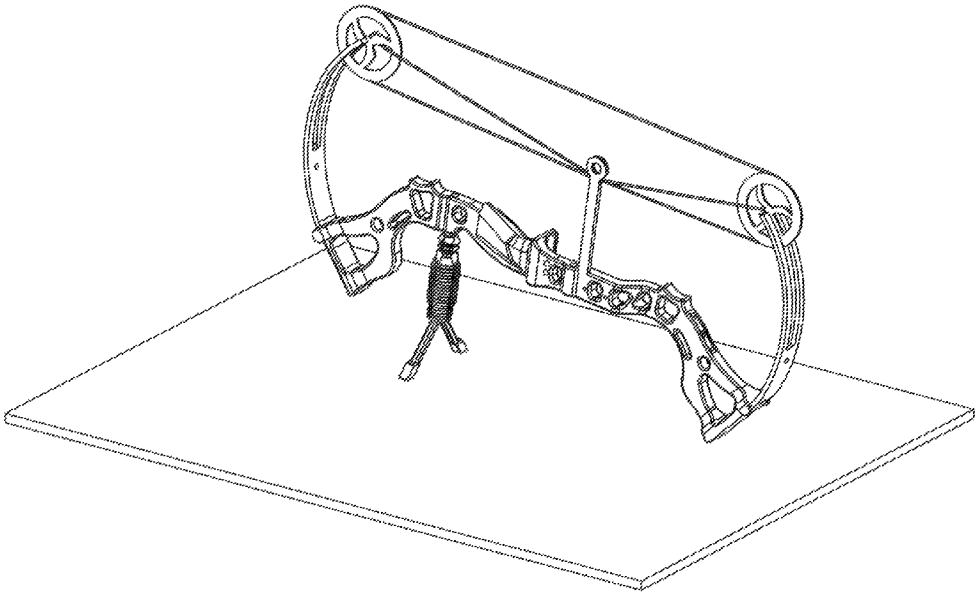
FIGS. 12 and 13 are perspective views of the stand affixed to an archery bow.

In order to deploy legs 17 and 18, they are simply manually pulled downwardly to withdraw them from base 23 whereby torsion spring 29 causes legs 17 and 18 to rotate on pins 19 and 20, respectively, and thereby separate outwardly. The stand then appears as shown in FIG. 8.

Figure 13:
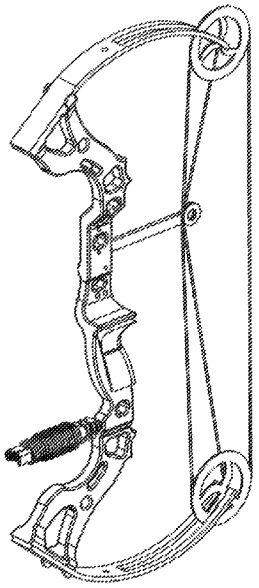

In order to collapse the stand, legs 17 and 18 are simply squeezed together and pushed upwardly into hollow base 23 whereby the enlarged end 26 of finger 25 enters resilient sleeve 39, disposed at the upper end of base 23, so that the friction between end 26 and resilient sleeve 39 causes legs 18 and 19 to be maintained in a withdrawn collapsed condition within hollow base 23, as shown in FIG. 13.

The embodiment of the archery bow stand according to this invention and shown in FIGS. 14-19 includes vibration dampeners 40 and 41 disposed adjacent feet 32 and 33 of legs 17 and 18, respectively. More specifically, each vibration dampener is secured to the respective foot 32 and 33 by means of interconnecting ring 42, formed on the periphery of each dampener, in cooperation with corresponding groove 43 formed in each foot 32 and 33.

Figure 16:
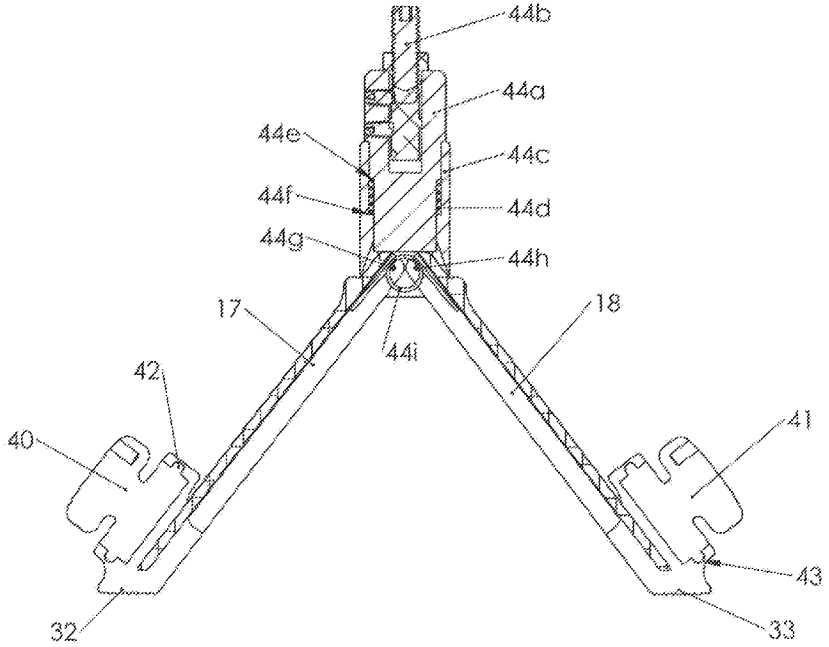
FIG. 16 is a cross-sectional view of the stand shown in FIG. 15.
Figure 17:
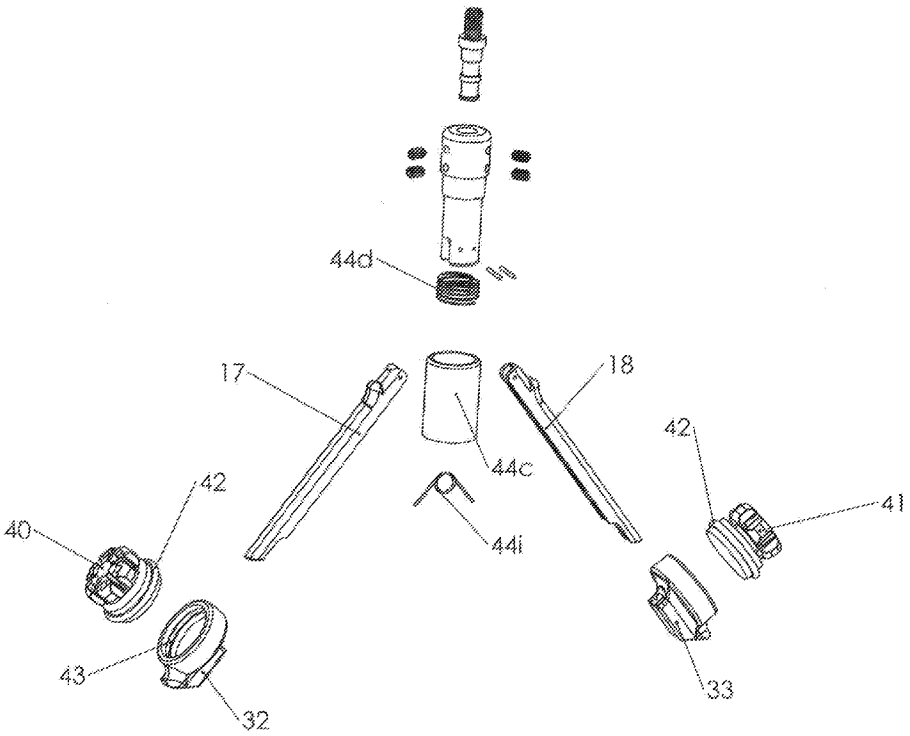
FIG. 17 is an exploded view of the stand.

As best viewed in FIGS. 16 and 17, base 44*a* is connectable to the archery bow by means of attachment screw 44*b*, as is well known. Spring sleeve 44*c* envelopes the circumference or base 44*a* with circular notch or ledge 44*e* formed around the outer surface of base 44*a* and circular notch or ledge 44*f* formed around the interior surface of spring sleeve 44*c*. Compression spring 44*d* is disposed between base 44*a* and spring sleeve 44*c* and between circular notches 44*e* and 44*f*. Since spring 44*d* urges spring sleeve 44*c* downwardly, the upper ends of legs 17 and 18 are enveloped by spring sleeve 44*c* so as to maintain legs 17 and 18 in a collapsed storage condition, as shown in FIG. 14.

Figure 18:
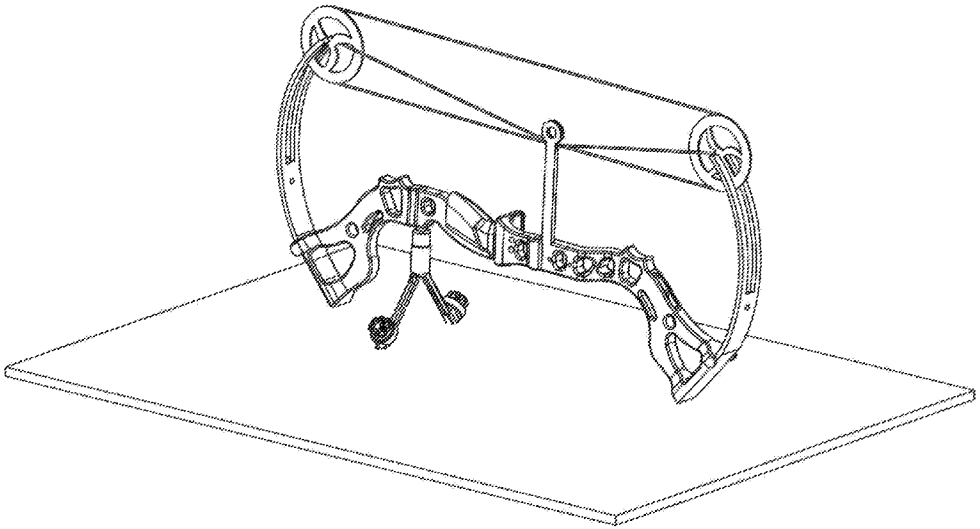
FIGS. 18 and 19 show the stand mounted on an archery bow.
Figure 19:
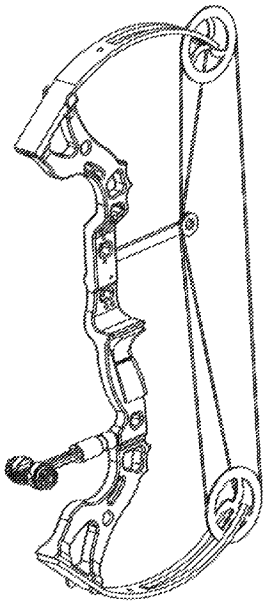
Figure 20:
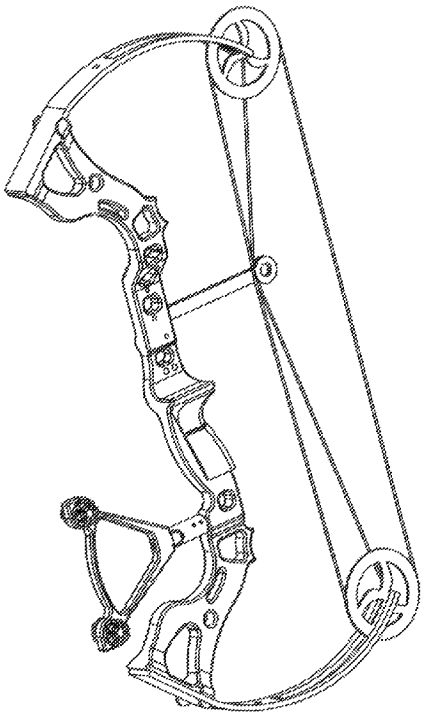
FIGS. 20, 21 and 22 are perspective views of a further embodiment of the archery bow stand according to this invention.
Figure 21:
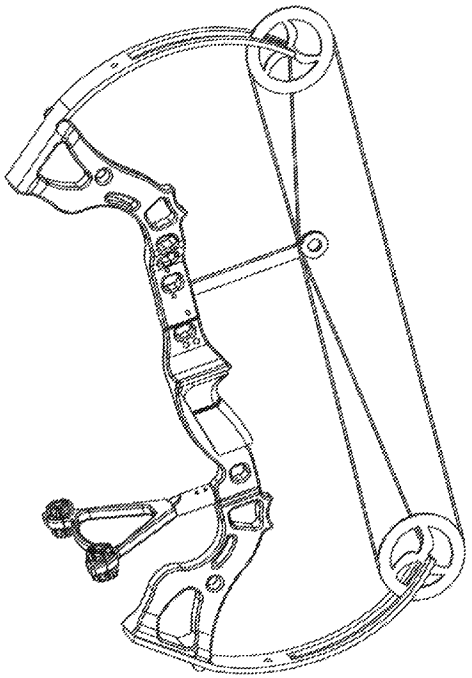
Figure 22:
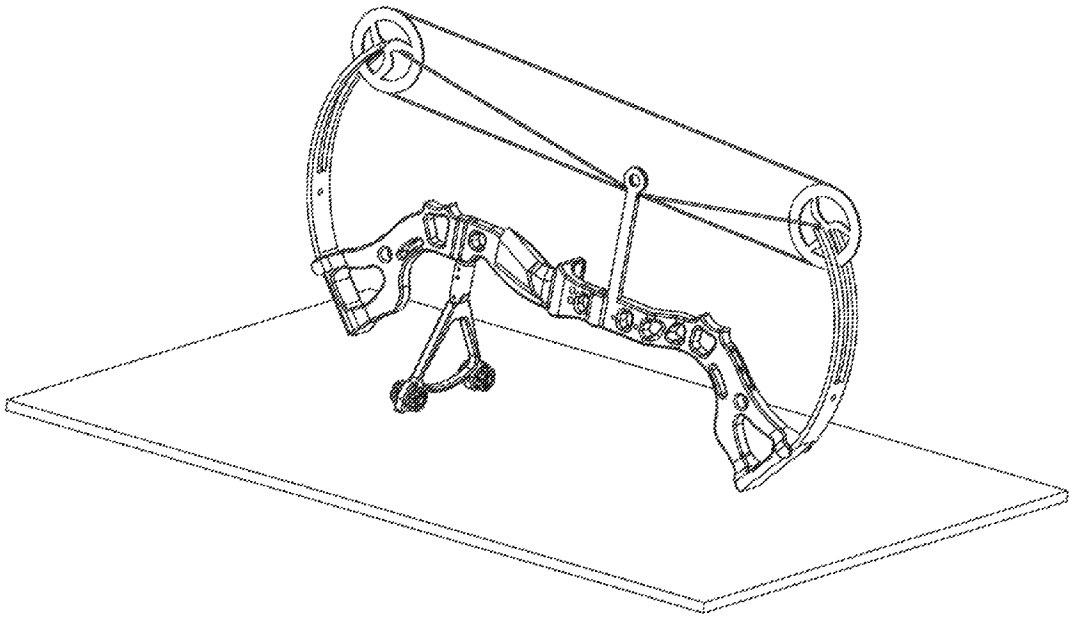
Figure 23:
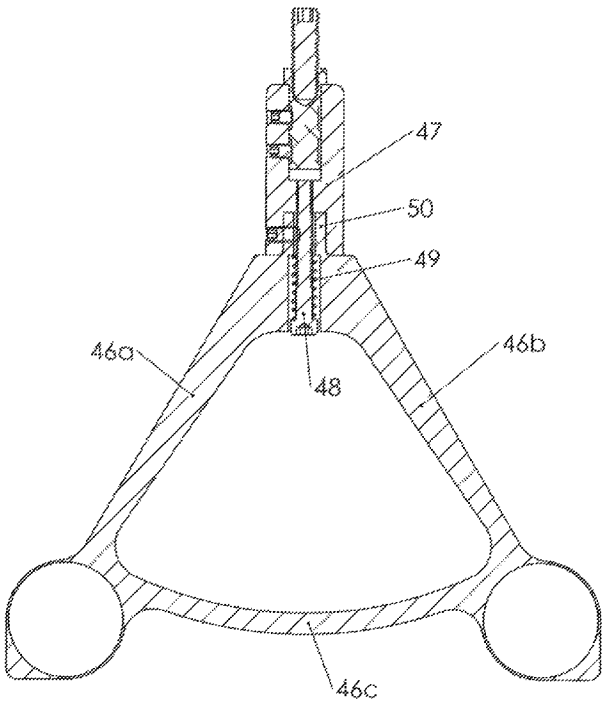
FIG. 23 is a cross-sectional view of the stand.
Figure 24:
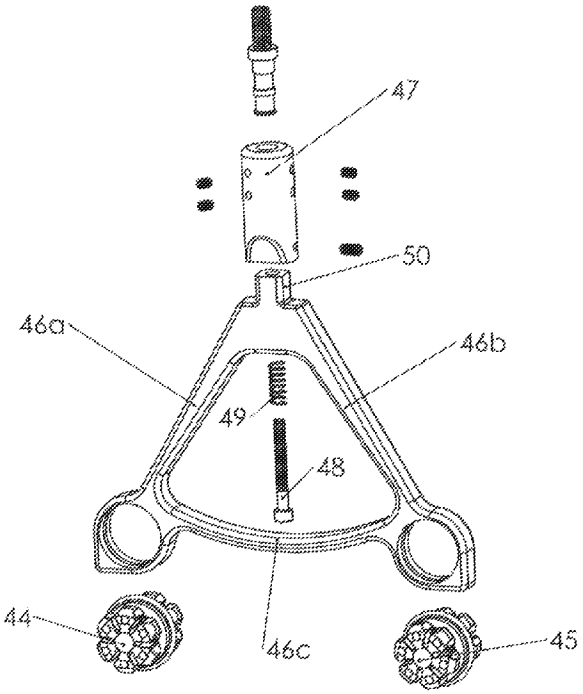
FIG. 24 is an exploded view thereof.
Figure 25:
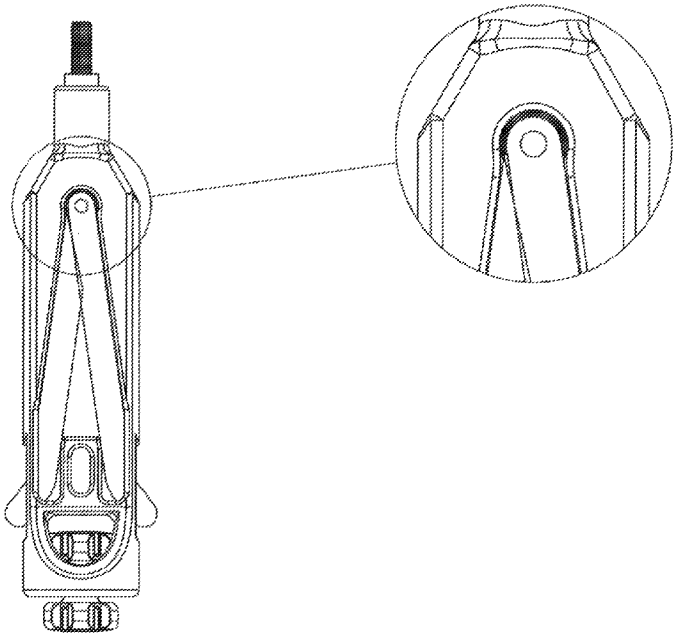
FIG. 25 is an elevational showing details of another embodiment of the invention.
Figure 26:
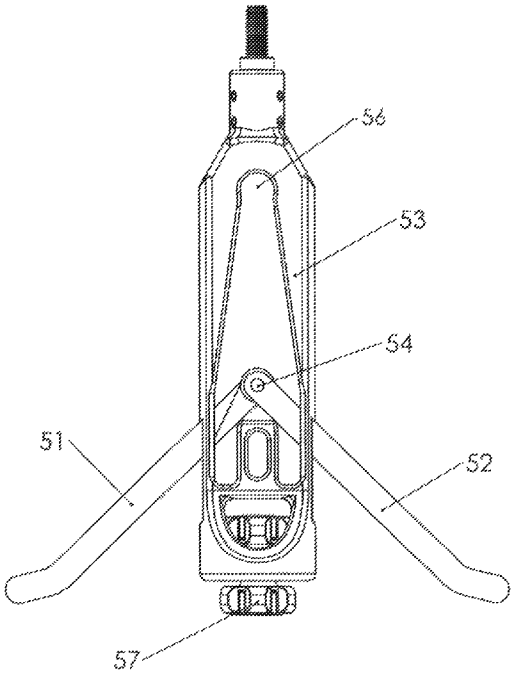
FIG. 26 shows the stand in a deployed condition.
Figures 1, 26:
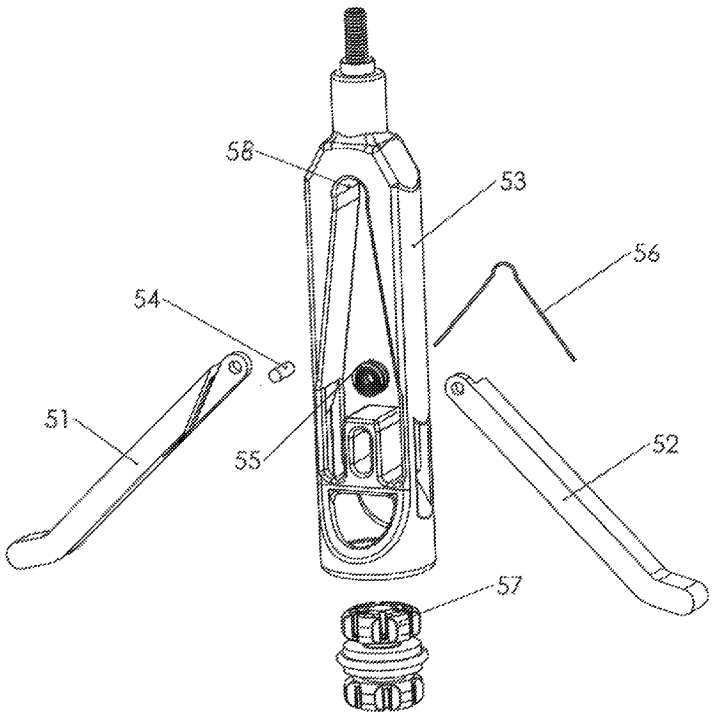
Figure 27:
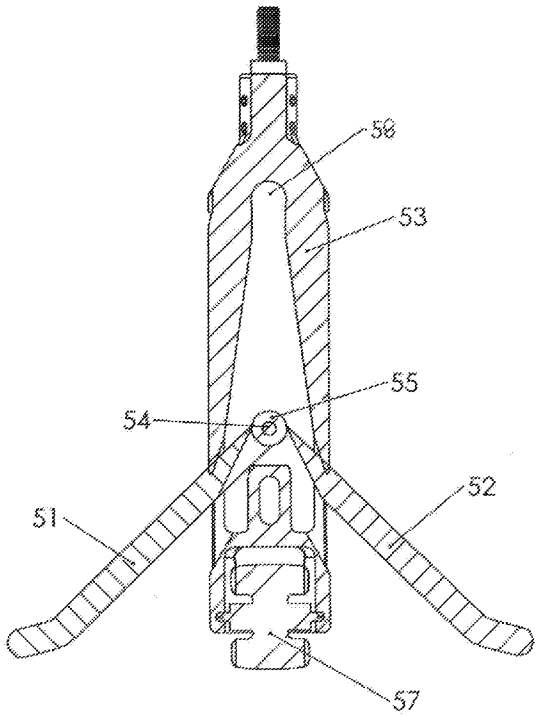
FIG. 27 is a cross-sectional view thereof.
Figure 28:
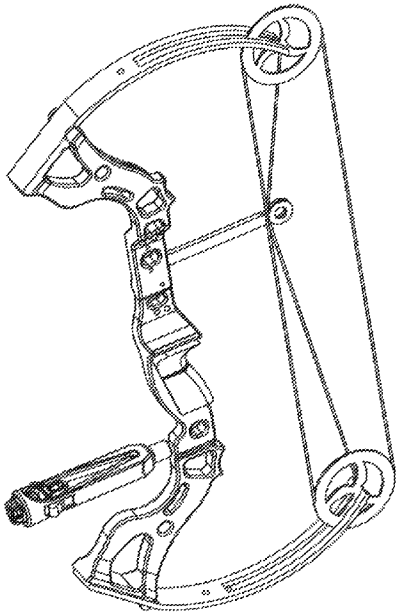
FIGS. 28 and 29 are perspective views showing operation of the stand.
Figure 29:
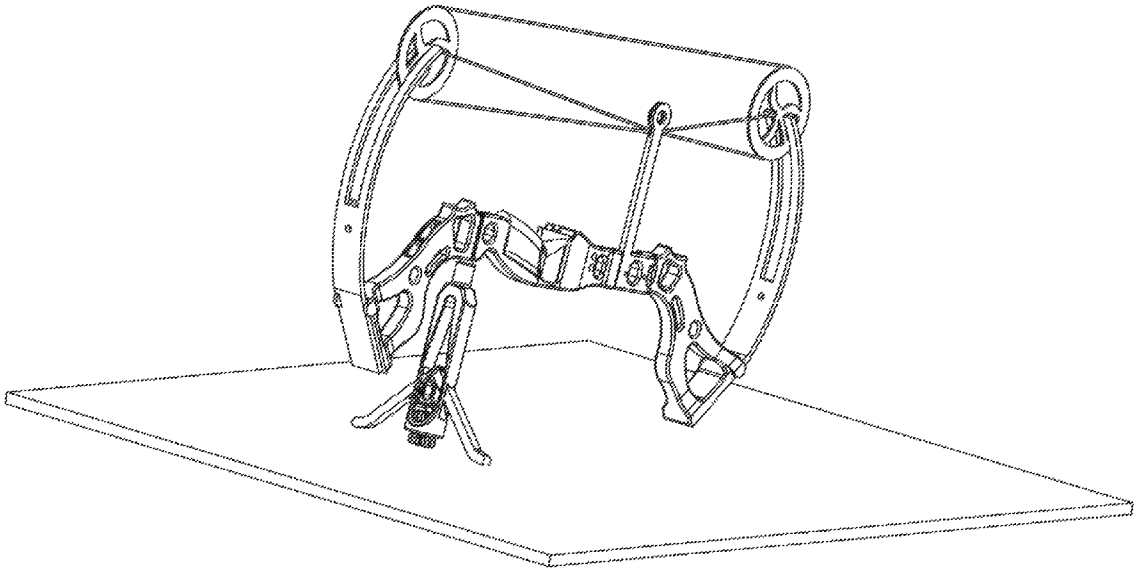

When it is desired to deploy the bow stand, the tension of compression spring 44*d* is overcome by sliding spring sleeve 44*c* upwardly of base 44*a*. By this means, legs 17 and 18 are released and caused to rotate outwardly about pivot pins 44*g* and 44*h*, respectively, by the action of the outer ends of torsion spring 44*i* disposed, respectively, in abutting relation with U-shaped legs 17 and 18. The bow stand is then fully deployed, as shown in FIG. 18.

Figure 14:
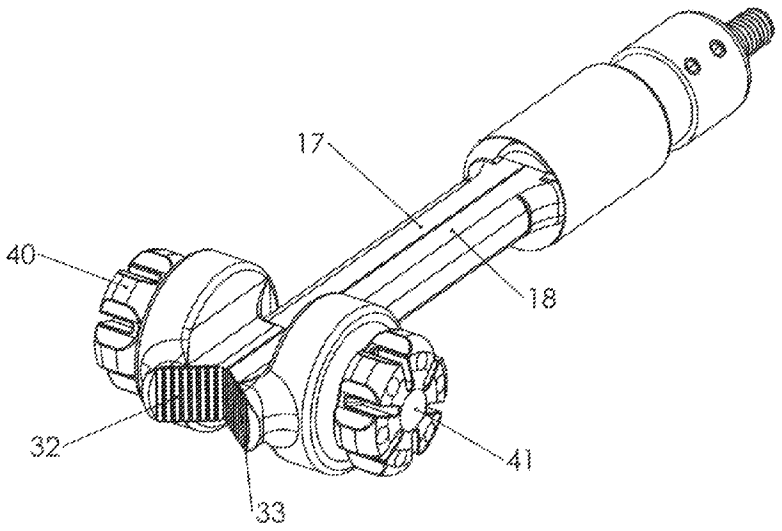
FIG. 14 is a perspective view of another embodiment of the archery bow stand according to this invention.
Figure 15:
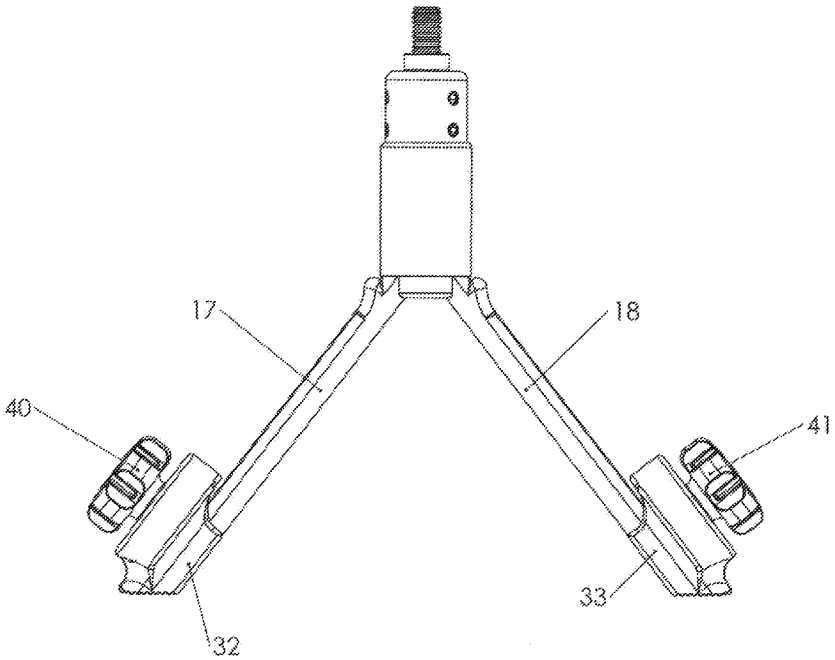
FIG. 15 shows the stand in a deployed condition.

In order to return the bow stand to a storage condition, legs 17 and 18 are manually squeezed together and pushed upwardly into base 44*a* whereby the upper ends thereof are enveloped by spring sleeve 44*c*, shown in FIG. 14, and maintained in a collapsed condition by the constant action of compression spring 44*d* urging spring sleeve 44*c* downwardly around the upper ends of legs 17 and 18.

In the embodiment of the archery bow stand shown in FIGS. 20-25, a pair of spaced vibration dampeners 44 and 45 are attachable to the archery bow stand. The stand includes legs 46*a* and 46*b* which converge at the upper ends and are separated at their lower ends by support bar 46*c*. The stand is rotatably mounted relative to base 47 by means of a combination of screw 48 and helical tension spring 49. Rectangular block 50 is normally disposed in the corresponding rectangular opening formed on the lower end of base 47. Therefore, when it is desired to rotate the archery bow stand from the position shown in FIG. 20 to the position shown in FIG. 21, it is simply necessary to withdraw the archery bow stand away from base 47, rotate is 90 degrees and then reinsert rectangular block 50 into the corresponding opening in base 47.

In the embodiment of the archery bow stand shown in FIGS. 25-29, legs 51 and 52 are rotatably mounted on base 53 by means of pin 54 which is slidable within base 53 and surrounded by resilient O-ring 55. In order to deploy legs 51 and 52, they are simply pulled downwardly from base 53 whereby spring 56 disposed within U-shaped legs 51 and 52 causes the legs to rotate outwardly about pin 54.

In order to store legs 51 and 52 within base 53, they are simply collapsed inwardly and pushed upwardly into base 53 whereby resilient O-ring 55 enters narrowed opening 58 formed on the interior upper end of base 53. Therefore, the frictional cooperation between resilient O-ring 55 and narrowed opening 58 causes legs 51 and 52 to be maintained in a closed and stored condition. Also, vibration damper 57 is secured to the lower end of base 53, as desired.

The invention claimed is:

1. An archery bow stand comprising a base;
said base having a periphery,
a pair of legs rotatably interconnected to said base,
said base comprising elongated slots disposed on the periphery of said base and opening outwardly of said base,
said legs being disposed within said slots respectively and rotatable outwardly from said base,
one leg rotatable from said base in a clockwise direction and the other leg rotatable from said base in a counterclockwise direction,
a pair of springs respectively comprising oppositely disposed ends and one said springs being interconnected to one of said legs at one end and to said base at the opposite end,
one of said slots comprising an end,
a V-shaped notch formed in said base at said end,
said one leg comprising a proximal end and the proximal end of said one leg being disposed in said notch,
an elongated apertured slot formed in said one leg at said proximal end,
a pin extending from said base in proximity to said notch and into said apertured slot,
said one leg being rotatable about said pin, and
said pin being slidable in said elongated apertured slot.

2. The archery bow stand according to claim 1 wherein mounting means extends from said base for attachment to an archery bow.

3. An archery bow stand comprising a base,
a pair of legs rotatably interconnected to said base,
tension means to cause said legs to diverge externally of said base,
said base being of an elongated circular configuration,
said base being hollow and having an upper end,
said upper end comprising an opening, and
a plug slidable within said base,
said legs rotatably mounted on said plug,
said sliding plug comprising a substantially circular enlarged end,
a resilient sleeve disposed at said upper end of said base,
said resilient sleeve having a substantially circular hollow opening,
the diameter of said opening of said resilient sleeve being less than the diameter of said base, the diameter of said enlarged end being greater than said diameter of said opening, and said enlarged end being receivable in said opening.

4. The archery bow stand according to claim 3 wherein said tension means comprises a spring, said spring comprises elongated ends, said legs comprise a bottom and spaced sides, and said ends are disposed in abutting relation respectively with said bottoms.

5. The archery bow stand according to claim 3 wherein a vibration dampener is secured to at least one of said legs.

6. The archery bow stand according to claim 3 wherein said legs are respectively rotatably interconnected to said base by means of a pair of pins.

7. The archery bow stand according to claim 6 wherein a vibration dampener envelopes said base.

8. The archery bow stand according to claim 3 wherein an O-ring surrounds said plug.

9. The archery bow stand according to claim 3 wherein mounting means extends from said base for attachment to an archery bow.

10. An archery bow stand comprising a substantially circular base, said base having an exterior surface, a pair of legs rotatably interconnected to said base, a substantially circular spring sleeve enveloping said base and having an interior surface, a pair of spaced circular ledges, one of said circular ledges formed on the interior surface of said spring sleeve, the other of said circular ledges formed on the exterior surface of said base, a cavity formed between said base and said spring sleeve and said circular ledges, a compression spring having spaced ends and being disposed in said cavity, and said ends respectively in abutting relation within said circular ledges.

11. The archery bow stand according to claim 10 wherein said compression spring urges said spring sleeve toward legs.

12. The archery bow stand according to claim 11 wherein said spring sleeve envelopes the interconnection of said legs.

13. The archery bow stand according to claim 10 wherein mounting means extends from said base for attachment to an archery bow.

* * * * *